United States Patent [19]

Konose

[11] Patent Number: 4,856,925

[45] Date of Patent: Aug. 15, 1989

[54] DEVICE FOR FIXING APPLICATOR ONTO COATING INSTRUMENT

[75] Inventor: Yoshiomi Konose, Fujioka, Japan

[73] Assignee: Mitsubishi Pencil Co., Ltd., Tokyo, Japan

[21] Appl. No.: 160,235

[22] Filed: Feb. 25, 1988

[30] Foreign Application Priority Data

Feb. 26, 1987 [JP] Japan ..... 62-27734

[51] Int. Cl.[4] ..... A46B 11/00

[52] U.S. Cl. ..... 401/290; 15/191 R; 15/194; 15/202; 401/284

[58] Field of Search ..... 401/290, 284, 290; 15/191 R, 191 A, 194, 202

[56] References Cited

U.S. PATENT DOCUMENTS

| | | | |
|---|---|---|---|
| 752,078 | 2/1904 | Burt et al. | 401/290 X |
| 2,564,184 | 8/1951 | Athans | 401/290 X |
| 2,882,544 | 4/1959 | Hadidian | 15/201 X |
| 4,548,524 | 10/1985 | Seager | 401/187 |

FOREIGN PATENT DOCUMENTS 59-135161 8/1984 Japan .

*Primary Examiner*—Steven A. Bratlie

*Attorney, Agent, or Firm*—Armstrong, Nikaido, Marmelstein, Kubovcik & Murray

[57] ABSTRACT

The present invention offers a device for fixing a writing or coating member in a writing or coating tool for a liquid composition, such as a writing brush, comprising a main body with a hole having an inner diameter smaller than the outer diameter of a plate portion provided at the rear end of the writing or coating member, a cutaway communicating from one side fringe of the main body to the hole with tapered side lines, a bow-shape leaf spring portion which is protruded from the fringe side opposite to the cutaway of the main body and lapped in such a manner that an intermediate portion approaches substantially in contact with the side face of the main body while its top end being maintained apart from the side face of the main body by a distance larger than the distance of a nearest approached portion, and 2 leg plates which are protruded from both the other fringes of the main body substantially vertically to the plane of the main body, and in the side opposite to the side where the leaf spring is located, while tops of the leg plates being slightly separated and bent oppositely and outwardly.

1 Claim, 3 Drawing Sheets

DEVICE FOR FIXING APPLICATOR ONTO COATING INSTRUMENT

BACKGROUND OF THE INVENTION

1. Field of the Invention

This invention relates to a device for fixing a writing or coating member such as brush onto a writing or coating tool containing writing ink, error correction liquid, liquid cosmetics, paint, adhesive and medicine.

2. Prior Art

According to a method for fixing a writing or coating member such as brush onto a writing or coating tool, already known in the prior art, a plate portion is formed on the rear end of a brush, etc. comprising a fibrous bundle, in which method the brush, etc. is fixed through said plate onto a specified position of the writing or coating tool. Where such a coating member is made of for example plastics, the plate portion might be formed by melting by heating and then solidifying the rear end of the member. Such an example is disclosed in pending U.S. patent application Ser. No. 019,393 filed on Feb. 26, 1987.

However, it is very difficult to form the plate portion with a constant thickness although it is easy to produce the plate portion by melting and solidifying.

If there is a difference in the thickness of various portions in the plate portion, the writing or coating member will not be secure when it is fixed in a writing or coating tool, without completely fitting with the mounting portion of the writing or coating tool.

In order to overcome the problem as above, there is provided a novel device for fixing a writing or coating member in a writing or coating tool, which is disclosed in pending U.S. patent application Ser. No. 036,234 filed on Apr. 9, 1987.

However, even if such device is used in a writing or coating tool to avoid an insecurely affixed writing or coating member, it tends to make the entire length of a writing or coating tool longer, which has been troublesome.

An object of the present invention is to provide a device for fixing a writing or coating member onto a writing or coating tool for a liquid compsition, securely even where there is a difference in the thickness of portions of the writing or coating member, such as a brush, and for fixing a writing or coating member onto a writing or coating tool, with an entire length of the tool which may be shorter than conventional ones even where there is a restriction of manufacture.

SUMMARY OF THE INVENTION

According to the present invention, a device is presented for securely fixing a writing or coating member in a writing or coating tool for a liquid, such as a writing brush, comprising a main body with a hole or aperture having an inner diameter smaller than the outer diameter of a plate portion provided at the rear end of the writing or coating member, with a cutaway communicating from one side fringe of said main body to said hole with tapered side lines, a bow-shape leaf spring portion which is protruded from the fringe side opposite to said cutaway of the main body and lapped in such a manner that an intermediate portion approaches substantially in contact with the side face of said main body while its top end being maintained apart from said side face of said main body by a distance larger than the distance of a nearest approached portion, and two leg plates which are protruded from both the other fringes of said main body substantially vertically to the plane of said main body and in the side opposite to the side where said leaf spring is located, while tops of said leg plates being slightly separated and bent oppositely and outwardly.

DETAILED DESCRIPTION AND THE PREFERRED EMBODIMENT OF THE INVENTION

The present invention is detailed in the following paragraphs referring to the attached drawing showing a manicure applicator according to the present invention. However, the invention is not limited thereby.

FIGS. 1–4 show a manicure applicator using the fixing device according to the present invention.

Figure 1:
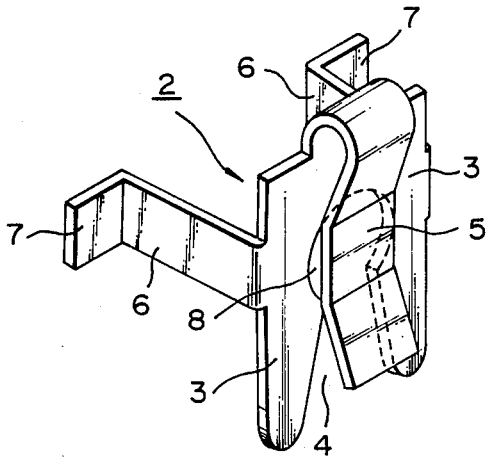
FIG. 1 is an oblique of a fixing device based on the present invention.
Figure 2:
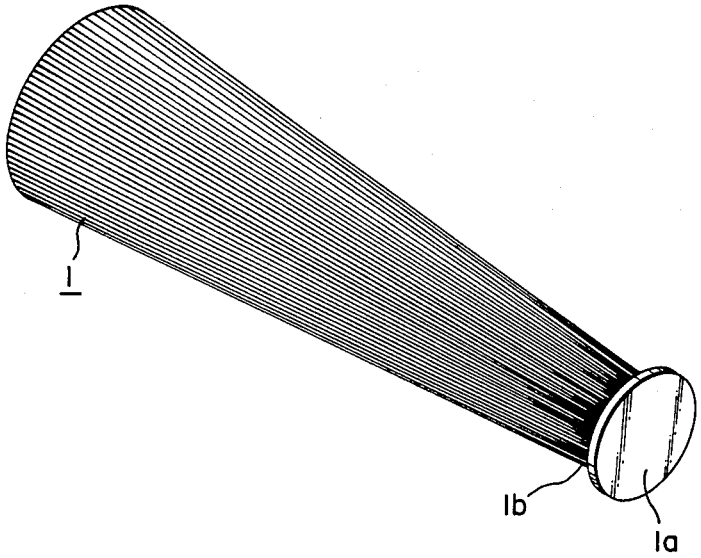
FIG. 2 shows the oblique view of a writing brush having a plate portion at rear end.

FIG. 1 shows an embodiment of the fixing device according to the present invention. FIG. 2 illustrates a brush for the manicure applicator, to be attached to the fixing device of FIG. 1.

Referring to these figures, 1 shows a brush comprising a plastic fiber bundle with a substantially circular plate portion 1*a* which is manufactured by melting the rear end of brush 1 by heating and then solidifying. The diameter of the plate portion 1*a* is larger than the diameter of a base portion 1*b* of brush 1. The fringe portion of the plate portion 1*a* is protruded in a flange shape, with a larger diameter than the base portion 1*b*.

2 is a fixing device for mounting brush 1. This fixing device 2 may be manufactured of a suitable metal or plastic material known in the prior art.

The fixing device 2 comprises a flat plate like main body 3, a leaf spring portion 5 extended and bent back from a side 1 of said main body 3 and two leg plates 6 which are protruded from both side fringes where said leaf spring portion 5 is located towards the side opposite to the bentback side of said leaf spring portion 5.

Substantially at the center of main body 3, a hole 8 is drilled with a diameter substantially equal to or slightly larger than the diameter of the base portion 1*b* of brush 1 to be fixed and smaller than the diameter of the plate portion 1*a* of said brush 1. A cutaway 4 is provided in the side opposite to the side where the leaf spring portion 5 of said hole 8 is located. The base portion 1*b* of the brush 1 is housed in said hole 8 through this cutaway 4.

The leaf spring portion 5 is extended from main body 3 and immediately bent back while approaching the main body 3 at a position corresponding to said hole 8 and slightly separating the main body 3 towards its top. Thus, the leaf spring is shaped like a bow in entirety. There is a gap between the main body 3 and a portion of the leaf spring portion 5 nearest to the main body 3. The gap must be as narrow as, when the brush 1 is mounted, the leaf spring portion 5 can push the plate portion 1*a* of brush 1.

Two leg plates 6, protruded from the main body 3, are separated gradually wider from each other as a distance from the main body 3 becomes larger. Both tops are bent outwardly in a substantial rectangular manner.

Figure 3:
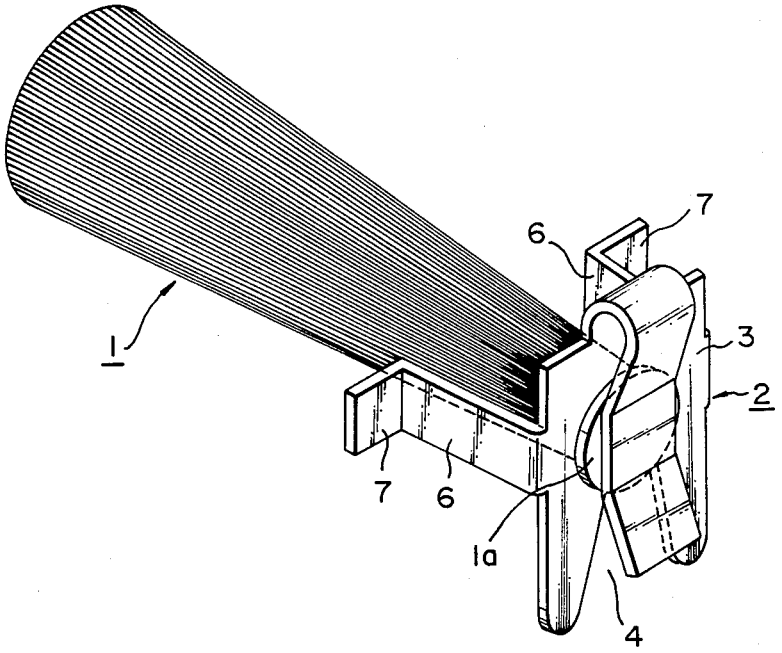
FIG. 3 illustrates an oblique view with the brush of FIG. 2 mounted on the fixing device of FIG. 1.

FIG. 3 shows a state where the brush 1 is attached to the fixing device 2. With the brush 1, the plate portion 1*a* is sandwiched between the main body 3 and the leaf spring portion 5 firmly not subject to relative movement with respect to the fixing device 2. The leaf spring portion 5 can hold securely the brush 1 without being affected by the change of the thickness in the plate portion 1*a* of the brush 1 because of its flexibility and resiliency.

Figure 4:
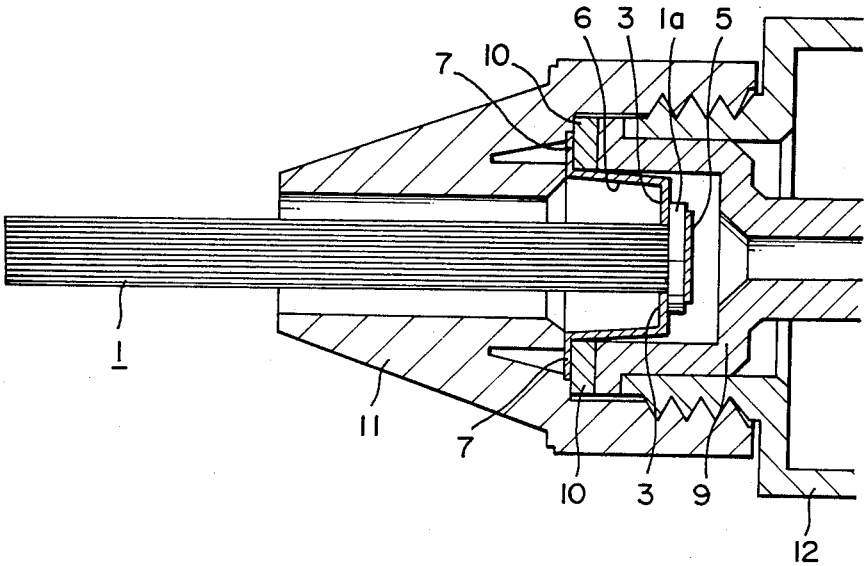
FIG. 4 shows a center section view of a part of a manicure liquid applicator equipped with the fixing device and the brush of FIG. 3.

FIG. 4 shows a state where the main body 3 and the fixing device 2 shown in FIG. 2 are actually mounted on a manicure applicator.

A manicure liquid flowing tube 9 is equipped on the inner portion of the front opening of a shaft body 12 of the manicure. A ring seal member 10 is attached to the front end while incorporating a brush 1 and a fixing device, as assembled in a state of FIG. 2, in the front side of said seal member 10 by sandwiching a mounting plate 7 between said seal member 10 and a top shaft 11.

It is easily understood that the fixing device 2 according to the present invention can be mounted securely in the writing or coating tool.

Therefore, by using the fixing device 2 of the present invention, the brush is maintained while being pushed onto the main body 3 by means of a flexible leaf spring 5. Accordingly, the brush can be firmly retained even with considerable difference, if any, in the thickness of the plate portion in the brush. Thus, the flange 1*a* of the coating member no longer in needs to be of uniform thickness to be securely held against the main body of a writing or coating tool.

In addition, with a fixing device according to the present invention, the portion for mounting leg plates, with which the fixing device is mounted onto a writing or coating tool, is located considerably in the front side of the brush fixing portion. In fact, the brush enters the main body of a writing or coating tool. Consequently, the length of such a writing or coating tool can be made significantly smaller than conventional writing or coating tools, even with restrictions in manufacture.

What is claimed is:

1. A device for securely fastening a writing or coating member into a writing or coating tool which comprises:

a main body having an aperture therethrough of a smaller diameter than the outer diameter of a plate portion provided at the rear end of said wriring or coating member;

a leaf spring portion which protrudes from a side of said main body and extends in a plane generally parallel to said main body having a central portion convex with respect to said main body so as to resiliently close said aperture, with the space between said convex portion and said main body being less than the thickness of said plate portion; and two projections protruding from side edges of said main body substantially vertically to the plane of said main body and in the direction opposite to the side where said leaf spring portion is located, the tops of said projections being bent oppositely and outwardly so as to allow fastening of said main body to said writing or coating tool.

* * * * *